United States Patent [19]

de Villemeur

[11] 3,942,855

[45] Mar. 9, 1976

[54] TOOL-FREE DETACHABLE ELECTRIC POWER CONNECTOR

[75] Inventor: Philippe de Villemeur, Maisons Alfort, France

[73] Assignee: Etablissements A. Gregoire & Barilleau

[22] Filed: Apr. 9, 1975

[21] Appl. No.: 566,385

Related U.S. Application Data

[63] Continuation of Ser. No. 420,943, Dec. 3, 1973, abandoned.

[52] U.S. Cl...... 339/21 R; 339/218 M; 339/252 P; 339/278 C

[51] Int. Cl.[2]..... H01R 13/06

[58] Field of Search..... 339/20–24, 339/62, 218, 153–156, 176, 252, 278

[56] References Cited

UNITED STATES PATENTS

| | | | |
|---|---|---|---|
| 2,292,049 | 8/1942 | Chirelstein | 339/62 |
| 2,351,632 | 6/1944 | O'Brien | 339/156 R |
| 2,745,931 | 5/1956 | Heibel | 339/218 R |
| 2,837,447 | 6/1958 | Weindel | 339/278 C |
| 3,142,000 | 7/1964 | Bernstein | 339/218 R |
| 3,569,899 | 3/1971 | Laser | 339/21 R |

FOREIGN PATENTS OR APPLICATIONS

| | | | |
|---|---|---|---|
| 639,091 | 11/1936 | Germany | 339/252 P |

OTHER PUBLICATIONS

IBM Bulletin, Bresg, Spring Contactor, 9–1967, Vol. 10, No. 4, p. 363.

*Primary Examiner*—Joseph H. McGlynn
*Attorney, Agent, or Firm*—Amster & Rothstein

[57] ABSTRACT

This connector consists of metal wire sections having a round or oval cross-sectional contour, which are equal in number to the electric conductors to be interconnected, each section comprising a straight or curved central portion, according to the particular position and orientation of the end portions of the electric conductors to be interconnected, and curved end portions bent to an arcuate configuration having a center angle of less than 180° to constitute a highly resilient loop, said wires consisting to this end of a high-grade steel core having a tensile strength of more than 80 kilograms per square millimeter and preferably of the order of 120 kg/sq.mm., coated with a copper layer having a thickness in excess of 0.3 mm and preferably of the order of 0.5 mm. This connector may be used notably for interconnecting electric conductors of the current lead-in type as depicted in the U.S. Pat. No. 3,777,300.

5 Claims, 10 Drawing Figures

TOOL-FREE DETACHABLE ELECTRIC POWER CONNECTOR

This is a continuation of application Ser. No. 420,943 filed Dec. 3, 1973, now abandoned.

This invention relates in general to electric appliances and has specific reference to electric connectors for power transmission and conduit means.

More particularly, the present invention is directed to provide an improved detachable connector for such electric power conduits which is adapted to be removed without using any tool, for example for use in power conduits or circuit elements utilizing the safety outlets disclosed in U.S. Pat. No. 3,777,300.

However, this device may also be used for connecting other electric power conduit means; in fact, in the aforesaid prior U.S. Pat. No. 3,777,300, electric power conduits are contemplated, i.e. conduits permitting the passage of relatively strong electric currents, of several amperes, for lighting, heating or similar purposes, or supplying current to miscellaneous household equipments.

Under these conditions, it is clear that the problem to be solved differs considerably from that of connections requiring a reliable contact under low current values, for example less than 1 ampere. In this last case, a known proposition consisted in providing satisfactory electric contacts by means of metal members having jointly good resilient and conducting properties; the metal member may consist of bronze or steel, which while being conducting materials of moderate electrical conductibility, have a satisfactory resiliency so that an efficient contact can be relied upon between the terminal (spade, or lug) and the portion to be connected. On the other hand, this type of connection is attended by serious difficulties when stronger currents are to be conducted therethrough.

To obtain satisfactory results under relatively high ampere values, it is known to use a metal such as copper having a good conductibility but a relatively poor resiliency, and to exert very considerable pressures between the connecting member and the member or members to be connected, in order to minimize the value of the contact resistance and, consequently, the final heating of the connection, a requirement which so far was met only by using tight screws; on the other hand, it is known that, as a result of the plastic but not elastic copper deformation under the pressure values contemplated, these connections require a serious supervision and the regular re-tightening of the screw means utilized therein, otherwise the connections are likely to become loose, thus entailing another expansion and a consequent deterioration of the contacts.

It is the essential object of the present invention to provide a connector having the same advantageous properties as those utilized up to now for low ampere values, this connector operating only by inherent resiliency while permitting the passage of relatively strong currents of the order of several amperes.

To this end, the connector according to this invention is characterised in that it comprises metal wire sections of round or oval cross-sectional shape, equal in number to the electric power conductors to be connected, each wire section comprising on the one hand a straight or curved central portion, according to the positions and relative orientation of the terminal portions of the electric conductors to be interconnected, and on the other hand end portions curved to form an arc having a centre angle of less than 180° and to constitute a strongly resilient loop, said wires consisting to this end of a steel core having a tensile strength greater than 80 kilograms per sq. mm. and preferably of the order of 120 kg/sq.mm., this steel core being coated with a copper layer having a thickness somewhat in excess of 0.3 mm, and preferably of the order of 0.5 mm, with a linear conductibility equivalent to that of the conductors to be interconnected, said wire sections being mounted and protected in a plastic case comprising at least one front face preventing any direct contact with the central portions of said metal wire sections and a back face insulating said sections, the end, loop-forming portions of said sections being allowed if desired to project somewhat from said case and adapted to provide automatically, due to the inherent resiliency of their arms and the ductibility of their copper coatings, a reliable and efficient electric contact with the electric conduits to be interconnected, along a length of at least 1.5 cm and preferably of the order of 2 to 3 cm.

The attached drawing illustrates diagrammatically by way of illustration various possible embodiments of the connector of this invention. In the drawings.

Figure 1:
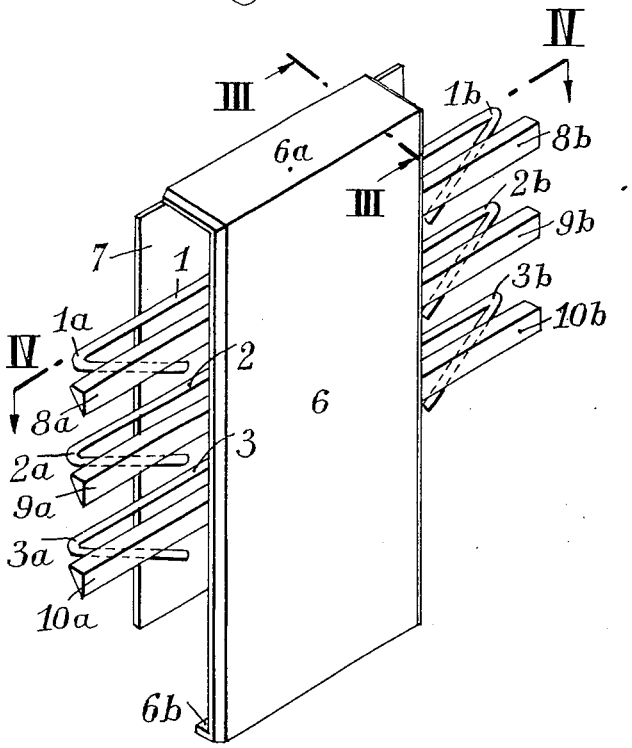
FIG. 1 is a perspective view of this connector.
Figure 2:
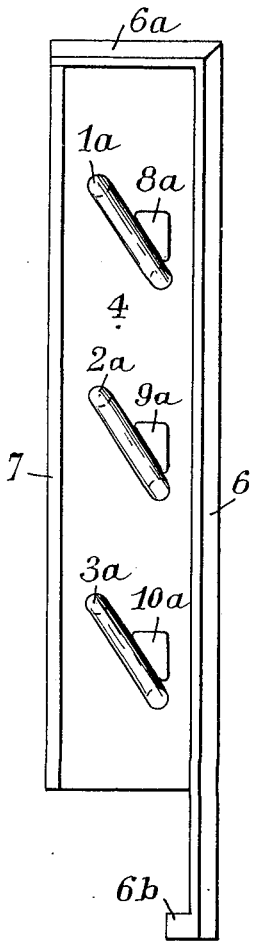
FIG. 2 is a side elevational view thereof.

The connector illustrated in the drawings comprises as its main component elements the three metal wire sections 1, 2 and 3 having the above-defined composition and structure, the ends 1*a*, 2*a*, 3*a* and 1*b*, 2*b* and 3*b* of these wires being curved backwards and downwards to provide loops; the central rectilinear portion of these metal wires is embedded in a block 4 of insulating plastic material rigid or solid with the connector case, in which they form preferably an elbow 5 for preventing any sliding movement of said wires parallel to themselves; the front face 6 of this plastic block has a lateral downward extension constituting the front wall intended for concealing the case, and the back face 7 has a lateral extension constituting the rear concealing wall somewhat wider than the front wall to which it is connected along its top edge by means of a coverforming portion 6*a*, the lower edge of this front wall 6 having an in-turned ledge 6*b* formed integrally therewith.

The case of this connector is completed by preferably triangular-sectioned side rods 8*a*, 9*a*, 10*a* and 8*b*, 9*b*, 10*b* extending from the plastic block and molded integrally therewith, these rods being longer than the ends 1*a*, 2*a*, 3*a* and 1*b*, 2*b* and 3*b* of said metal sections; their function will be explained presently.

When this connector is used with current outlets of the type described and illustrated in the aforesaid U.S.

Pat. No. 3,777,300, the current outlets 11 are adapted to be fitted into the side portions of the connector case until they abut its central portion 4. In this case, each loop of said metal sections 1, 2, 3 is slidably engaged into one of the channels 12, 13, 14 of the current outlet 11, and resiliently clamped therein, its free arm bearing freely against the rear face of the current outlet 11 while its other arm is resiliently clamped between the two arms of the electric strips or conductors 15, 16 and 17 lining the bottom of each channel 12, 13, 14.

Figure 9:
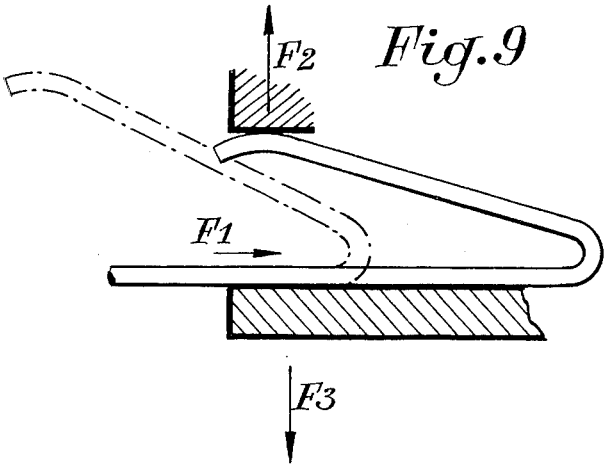
FIGS. 9 and 10 are a longitudinal section and a cross-section, respectively, illustrating diagrammatically an advantageous feature of this connector.
Figure 10:
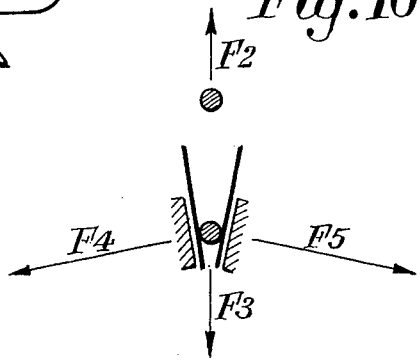
Figure 3:
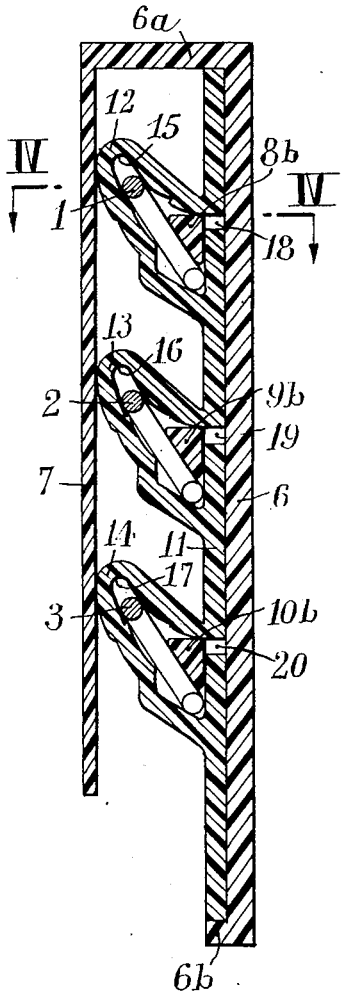
FIG. 3 is a vertical section showing this connector of this invention wired on to one terminal or end of a current outlet according to aforesaid prior patent, the section being taken along the line III—III of FIGS. 1 and 4.

Thus, as illustrated in FIGS. 9 and 10, a resilient system is provided wherein the single plug-in force F1 (mostly a manual force, that is, without the use of any tool) is transformed into a considerably greater pressure or clamping force due to two simultaneous decompositions, of the wedge-action type, the first decomposition (F1 converted into F2 and F3) being made possible with wide manufacturing tolerance by the fact that the female portion is capable of undergoing substantial elastic deformations, thus permitting the proper occurence of the second decomposition (F3 converted into F4 - F5) resulting this time from the deformation of the female portion, the strip along or with its support, whether the latter has undergone a deformation within or beyond the elastic limit of the material constituting said strip and/or its support.

The wedge constituted by the loop-shaped end portions 1*a*, 2*a* and 3*a* of conductors 1 to 3 causes the force F1, generally of manual origin, exerted during the plug-in step, to be decomposed into two double clamping reaction forces F2 and F3 considerably greater than F1. The force F3 is decomposed again into two other clamping forces F4 and F5 considerably greater than F3 and still greater than F1.

Simultaneously, the rods 8, 9 and 10 cover the slots 18, 19 and 20 previously connecting the inner space of said channels to the outside, and through which access could be had beforehand to the metal sections 1, 2 and 3 connected to the electric conductors 15, 16 and 17, so that serious accidents might occur.

The curved ends of the loop portions of metal wire sections 1, 2 and 3 may project from the front face 6 of the insulating case of the connector to an extent corresponding to the minimum length of the desired line contact between the wires and the conductors, as required to ensure a good electric contact therebetween; in this case it is only necessary that the end of the current lead-in to be connected up be engaged under the corresponding extension of the front face or wall of the case, in order to have the certainty that a line of contact of sufficient length is obtained between the metal wire sections of the connector and the electric conductors of the current lead-in.

Of course, the embodiment described hereinabove with reference to the drawings should not be construed as limiting the scope of the invention since various modifications may be brought thereto without departing from the basic principles of the invention.

Figure 4:
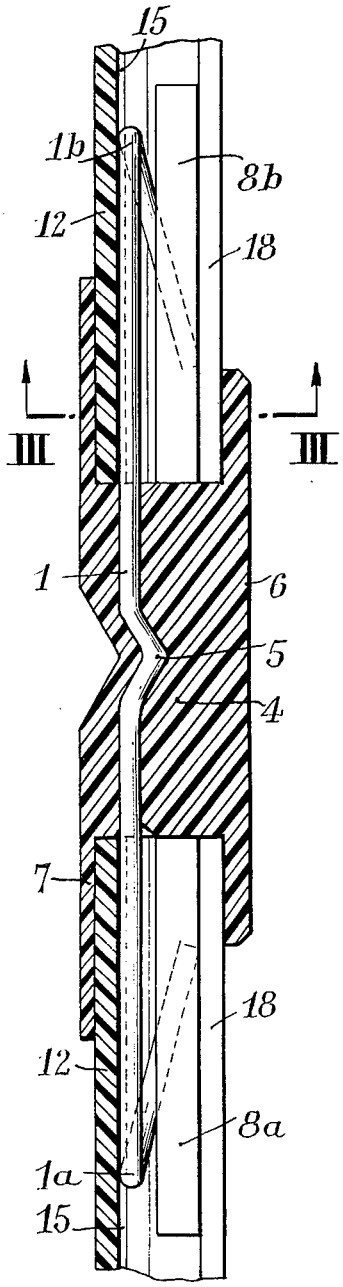
FIG. 4 is a similar cross-sectional view taken in the direction of the arrows IV—IV of FIGS. 1 and 3.
Figure 5:
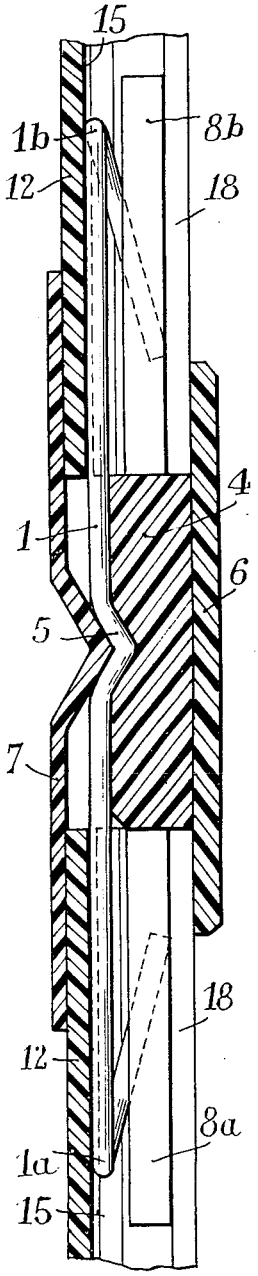
FIG. 5 is a view similar to FIG. 4 but showing a modified embodiment.
Figure 6:
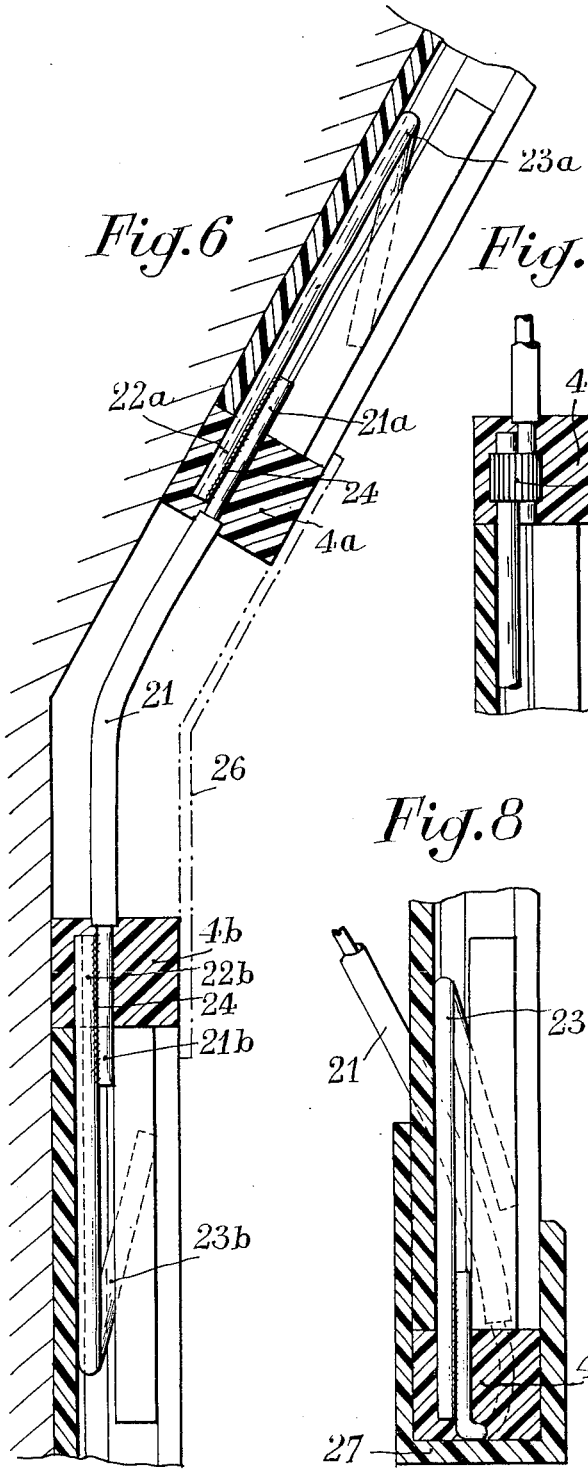
FIG. 6 is a similar view of an alternate form of embodiment.
Figure 7:
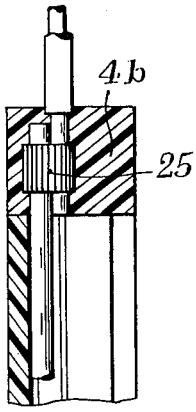
FIGS. 7 and 8 illustrate modified embodiments of the lower and upper portions of FIG. 6, respectively.
Figure 8:
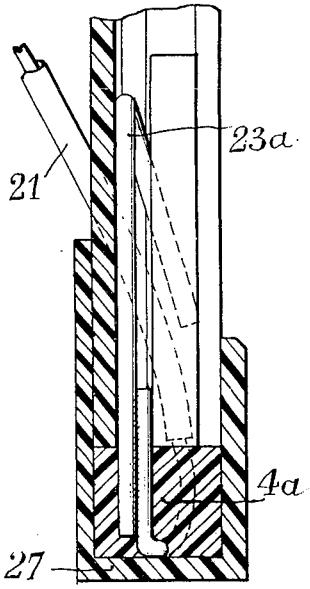

Thus, notably, the plastic block 4, instead of being moulded integrally with the case 6, 6*a* and 7, as shown in FIG. 4, may be formed separately, possibly from a different plastic stock, this block 4 being simply fitted or welded for example by supersonic frequency welding to the walls of said case, as shown in FIG. 5; though the central portion of the connector, with its plastic block 4 and its case, is shown as constituting a flat element to permit the connecting up of aligned conductors, it may also be curved in any desired manner, notably by bending same at 90° either inwards or outwards for making angular connections; if the electric conduits to be connected up do not form a standard angle between them, a flexible connection may be used as shown in FIG. 6, this connection consisting of a pair of plastic blocks 4*a* and 4*b* having embedded therein the stripped ends 21*a* and 21*b* of flexible wires 21 electrically connected to the inner ends 22*a*, 22*b* of electric wires having their outer ends formed into loops 23*a*, 23*b* similar to the loops 1*a*, 1*b* of the preceding Figures; the electric connection may be obtained by welding, as shown at 24 in FIG. 6, or squashing a sleeve 25 as shown in FIG. 7; the use of a mask 26 may of course be contemplated; to connect current inlets or leadins as shown and described in said prior patent, a connection of the type illustrated in FIGS. 6 and 7 may be used, but only one-half thereof is maintained, the flexible wires 21 being connected to the other network or mains; instead of being connected externally to the network or mains as shown in FIGS. 6 and 7, the flexible wires 21 may be connected internally; in this last instance it is easier to connect them electrically to the loops 23*a* or 23*b* by welding or otherwise, as shown in FIG. 8; a cap 27 acting as a protection mask and holding the connection 4*a* may be provided in this case.

Although typical embodiments of this invention have been shown and described herein, it will readily occur to those conversant with the art that various modifications and variations may be brought thereto without departing from the basic principles of the invention as set forth in the appended claims.

What is claimed as new is:

1. Tool-free detachable connector comprising a housing having a front face, a rear face spaced from and extending parallel to said front face and block means connecting said front and rear faces;

a plurality of wires each having a section embedded in said block means and end sections extending longitudinally from said block means;

said wires each consisting of a steel core having a tensile strength greater than 80 kilograms per square millimeter and each said core having a copper layer thereon with a thickness greater than 0.3 millimeter; and each said end section of each said wire comprising two straight connected arms, the first straight arm being a longitudinal extension of said section embedded in said block means, and the second straight arm forming an acute angle with said first straight arm and thereby defining a resilient loop, each said arm adapted to provide longitudinally extending electrical contact as a connector.

2. Connector according to claim 1 wherein said block means is centrally located in said connector and includes a plurality of channels corresponding to said wires, each channel having a centrally located depressed portion through which a respective wire is correspondingly depressed to prevent relative longitudinal movement.

3. Connector according to claim 1 wherein said block means comprises a pair of individual spaced blocks within each of which said wires is embedded.

4. Connector according to claim 3 wherein the faces are formed with part thereof at an incline so that said individual blocks have an angle relationship to each other, and each said individual wire includes a central flexible part extending longitudinally between said inclined blocks.

5. Connector according to claim 1 wherein a plurality of rods are provided corresponding in number to said wires, each individual rod extending through said block means and alongside a respective wire for a distance slightly more than the length of an individual resilient loop.

* * * * *